US012691359B2

(12) United States Patent
ZiYan et al.

(10) Patent No.: US 12,691,359 B2
(45) Date of Patent: Jul. 28, 2026

(54) EDGE SHARPENING TOOL FOR ACRYLIC WAX SCRAPER

(71) Applicant: Xiamen Chixue Sports Goods Co., Ltd., Xiamen (CN)

(72) Inventors: Pu ZiYan, Xiamen (CN); Yu ZiQi, Xiamen (CN)

(73) Assignee: Xiamen Chixue Sports Goods Co., Ltd., Xiamen (CN)

( * ) Notice: Subject to any disclaimer, the term of this patent is extended or adjusted under 35 U.S.C. 154(b) by 304 days.

(21) Appl. No.: 18/432,108

(22) Filed: Feb. 5, 2024

(65) Prior Publication Data

US 2024/0342581 A1 Oct. 17, 2024

(30) Foreign Application Priority Data

Apr. 17, 2023 (CN) ..... 202320858433.5

(51) Int. Cl.
*B24D 15/06* (2006.01)
*A63C 11/06* (2006.01)
(Continued)

(52) U.S. Cl.
CPC ..... *A63C 11/06* (2013.01); *B24D 15/06* (2013.01); *A63C 3/10* (2013.01); *A63C 11/04* (2013.01)

(58) Field of Classification Search
CPC ..... B24D 15/06; A63C 11/06; A63C 11/04
(Continued)

(56) References Cited

U.S. PATENT DOCUMENTS 1,594,246 A * 7/1926 Dechert ..... B23D 67/00 76/82
4,905,338 A * 3/1990 Mascia ..... A63C 11/04 280/809

(Continued)

OTHER PUBLICATIONS

FastMax-Eversharp (Wax Scraper Sharpening Tool) found at: https://skifastwax.com/products/eversharp-wax-scraper-sharpening-tool?srsltid=AfmBOorj3X84rfjCdTUHdQOEIXmEv5DgFQxSRg11viMqM1SPcM3fkxmd (Year: 2026).*

(Continued)

*Primary Examiner* — Mahdi H Nejad
(74) *Attorney, Agent, or Firm* — Jose Cherson Weissbrot

(57) ABSTRACT

The present application relates to an edge sharpening tool for an acrylic wax scraper, including a base plate, where baffles are symmetrically installed on the top surface of the base plate, a file is placed between the baffles, the baffles each are provided with a bottom surface that is in an L-shaped configuration with the baffle, the side of the bottom surface away from the end of the baffle in the length direction is provided with a protruding section serving as a limit block, and the limit block limits the movement of the file. In the present application, the movement of the file is limited by the limit block, and the file is pressed and fixed by the baffles, resulting in a reliable and firm structure. Due to the limit of the symmetrically arranged baffles, it is convenient to scrape an acrylic wax scraper with easy operation. Moreover, the distance between the two baffles can be adjusted, so that it is suitable for edge sharpening of acrylic wax scrapers with different thicknesses. Therefore, a simple edge sharpening tool for an acrylic wax scraper is achieved, with the characteristics of low cost and easy operation.

11 Claims, 2 Drawing Sheets

(51) Int. Cl.

| | |
|---|---|
| ***B24D 15/00*** | (2006.01) |
| *A63C 3/10* | (2006.01) |
| *A63C 11/04* | (2006.01) |

(58) Field of Classification Search
USPC ..... 451/555
See application file for complete search history.

(56) References Cited

U.S. PATENT DOCUMENTS

| | | | | |
|---|---|---|---|---|
| 5,461,943 | A * | 10/1995 | Munkel | B24D 15/06 76/89.2 |
| 5,636,556 | A * | 6/1997 | Friedlander | B24D 15/06 76/89.2 |
| 10,556,324 | B1 * | 2/2020 | Torres | B26B 19/3846 |
| 2003/0134583 | A1 * | 7/2003 | Gallegos | B24B 3/60 451/349 |
| 2008/0166959 | A1 * | 7/2008 | Williams | B24D 15/06 451/552 |

OTHER PUBLICATIONS

SKATEPRO- Plexi Scraper Sharpener Found at: https://www.skatepro.com/en-us/759-37988.htm?srsltid=AfmBOor42OkHLNkcb1JsHfiOjdZf4IK8p6k0_tLOgBbIZMbNVe4xqpbs (Year: 2026).*

Wax Scraper Tuner - Repair, Recover and Sharpen Your Ski or Snowboard Waxing Tools (Scraper Tuner) (Black) Found at: https://www.amazon.com (Year: 2026).*

Snowboard Tuning: Scraper sharpening, scraping wax, brushing the base Found at: https://www.youtube.com/watch?v=bNKpHMj_kYY (Year: 2023).*

Igoskitool website Found at: https://igoskitool.com/collections/frontpage (Year: 2026).*

Skiman Wax scrapers sharpener Found at: https://www.tesmasport.com/skiman-wax-scrapers-sharpener (Year: 2026).*

How to Use the Woodsmith Scraper Sharpening System Found at: https://www.youtube.com/watch?v=TJuSqizzYhw (Year: 2020).*

Reciprocating Skate Blade Sharpener; Document ID: WO 2010069082 A1; Date Published: Jun. 24, 2010; Inventor: Frommer Thomas P; Application No. CA 2009001890 W; Date Filed: Dec. 21, 2009 (Year: 2010).*

* cited by examiner

EDGE SHARPENING TOOL FOR ACRYLIC WAX SCRAPER

CROSS REFERENCE TO THE RELATED APPLICATIONS

This application is based upon and claims priority of Chinese Patent Application No. 2023208584335, filed on Apr. 17, 2023, the entire contents of which are incorporated herein by reference.

TECHNICAL FIELD

The present application relates to the technical field of ski maintenance and repair, and in particular to an edge sharpening tool for an acrylic wax scraper.

BACKGROUND

Skis belong to skiing equipment, while ski wax is the most important in the ski maintenance process. Waxing skis can bring the thrill of high-speed skiing and allow free turns, while reducing the risk of damage to the surface of the board and prolonging its service life. In the process of waxing skis, a wax scraper is necessary. Acrylic, also known as specially treated plexiglass, is an upgrading product of plexiglass and has the characteristics of good plasticity, high weather resistance, and long service life, thus being very suitable for the manufacture of wax scrapers for skis. However, acrylic wax scrapers will become blunt after a period of use, affecting the wax scraping effect. At this time, the acrylic wax scrapers need to be sharpened, as such, an edge sharpening tool for an acrylic wax scraper is proposed.

SUMMARY

To solve the above-mentioned problem in the background, the present application provides an edge sharpening tool for an acrylic wax scraper.

The present application adopts the following technical solution: An edge sharpening tool for an acrylic wax scraper, including a base plate, where baffles are symmetrically installed on a top surface of the base plate, a file is placed between the baffles, the baffles each are provided with a bottom surface that is in an L-shaped configuration with the baffle, a side of the bottom surface away from an end of the baffle in a length direction is provided with a protruding section serving as a limit block, and the limit block limits a movement of the file.

Preferably, the top surface of the base plate is provided with a plurality of screws and matching nuts. The bottom surface is fixed on the top surface of the base plate through the screws and the nuts.

Preferably, the baffles each are provided with a notch. The file is placed in a space formed between the notch and the base plate.

Preferably, the notch is provided in the middle of the baffle adjacent to the bottom surface.

Preferably, the baffles press and fix the file.

Preferably, the bottom surface is symmetrically arranged at two ends of the baffle adjacent to the notch.

Preferably, the bottom surface is bent outward.

Preferably, the bottom surface is provided with a long cutout along a bending direction. The screws are inserted into the baffles through the long cutout, and the baffles are fixed by the nuts.

Preferably, the long cutout has an oblong shape.

Preferably, through the oblong long cutout, the baffles can be moved to increase or decrease the distance between the two baffles, and the matching nuts are used for pressing and fixation.

Compared to the prior art, the present application has the following advantages:

1. In the present application, due to the limit of the horizontal movement of the file by the limit block, it is convenient to scrape an acrylic wax scraper between two baffles to re-sharpen the blunt wax scraper due to long-term use, thus realizing reuse. Therefore, a simple edge sharpening tool for an acrylic wax scraper is achieved, with convenient operation, prolonged service life, and low cost.
2. In the present application, the file is pressed and fixed by the baffles together with the screws and the matching nuts, resulting in a reliable and firm structure, and ensuring a stable fixation of the file.
3. In the present application, a certain space allowing a relative movement of the oblong long cutout and the screw fixed on the base plate is formed in a width direction, so that the distance between the two baffles can be increased or decreased, and the nuts are used for fixing the baffles, which realizes edge sharpening of acrylic wax scrapers with different thicknesses.

In the figures: 1. base plate; 11. screw; 111. nut; 12. file; 2. baffle; 21. bottom surface; 211. limit block; 212. long cutout.

DETAILED DESCRIPTION OF THE EMBODIMENTS

In order to facilitate understanding of the present application, the present application will be described more comprehensively below with reference to the relevant drawings. Several embodiments of the present application are given in the accompanying drawings. However, the present application can be implemented in different forms and is not limited to the embodiments described herein. On the contrary, these embodiments are provided to enable more thorough and comprehensive understanding of the disclosure of the present application.

It should be noted that when an element is described as being "fixedly arranged" on another element, it can be directly on the another element or intervening elements can be present. When an element is described as being "connected" to another element, it can be directly connected to the another element or intervening elements can be present. The terms "vertical", "horizontal", "left", "right", and similar expressions are used herein for the purpose of illustration only.

Unless otherwise defined, all technical and scientific terms used herein have the same meanings as those commonly used by one of ordinary skills in the art of the present application. The terms used herein in the description of the present application are only for the purpose of describing specific embodiments, and not to limit the present application. The term "and/or" as used herein includes any and all combinations of one or more of the associated listed items.

Embodiment 1

Figure 1:
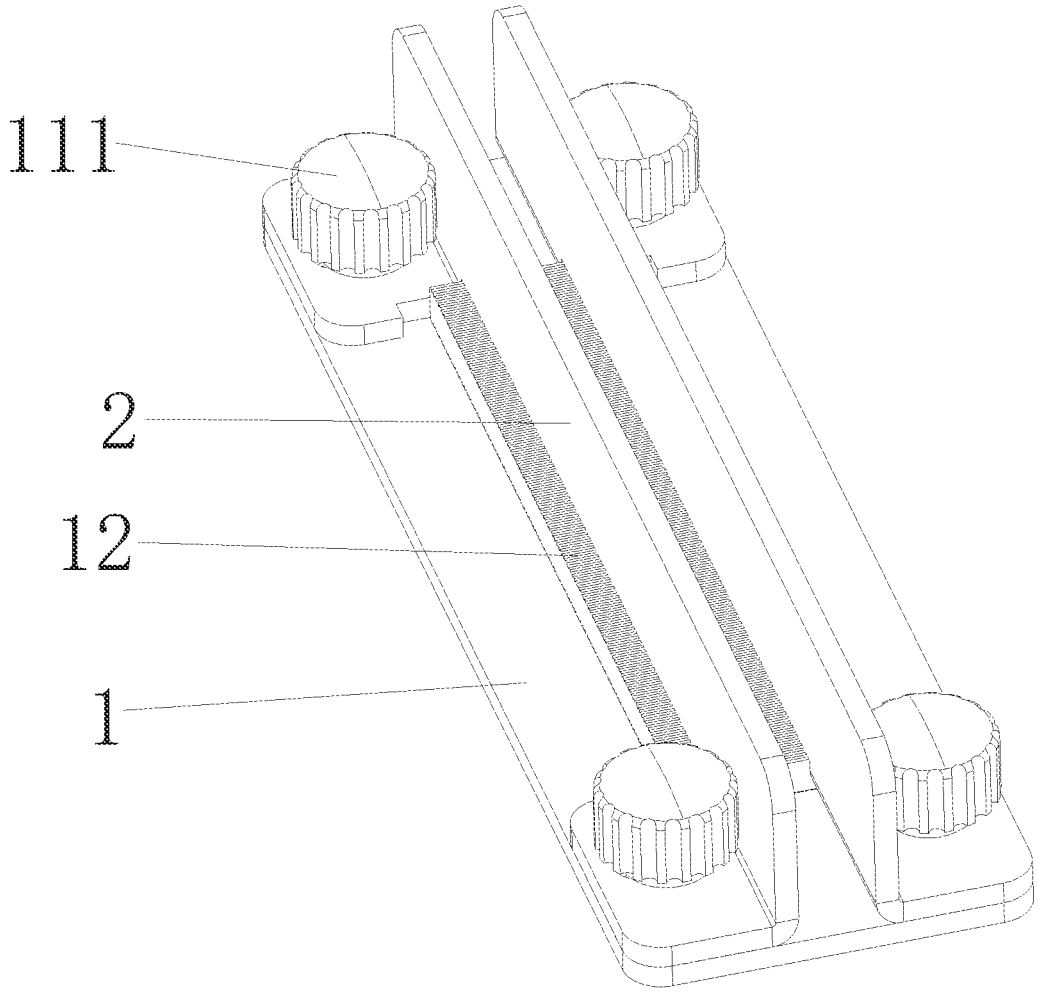
FIG. 1 is a schematic diagram showing the overall structure of the present application.
Figure 2:
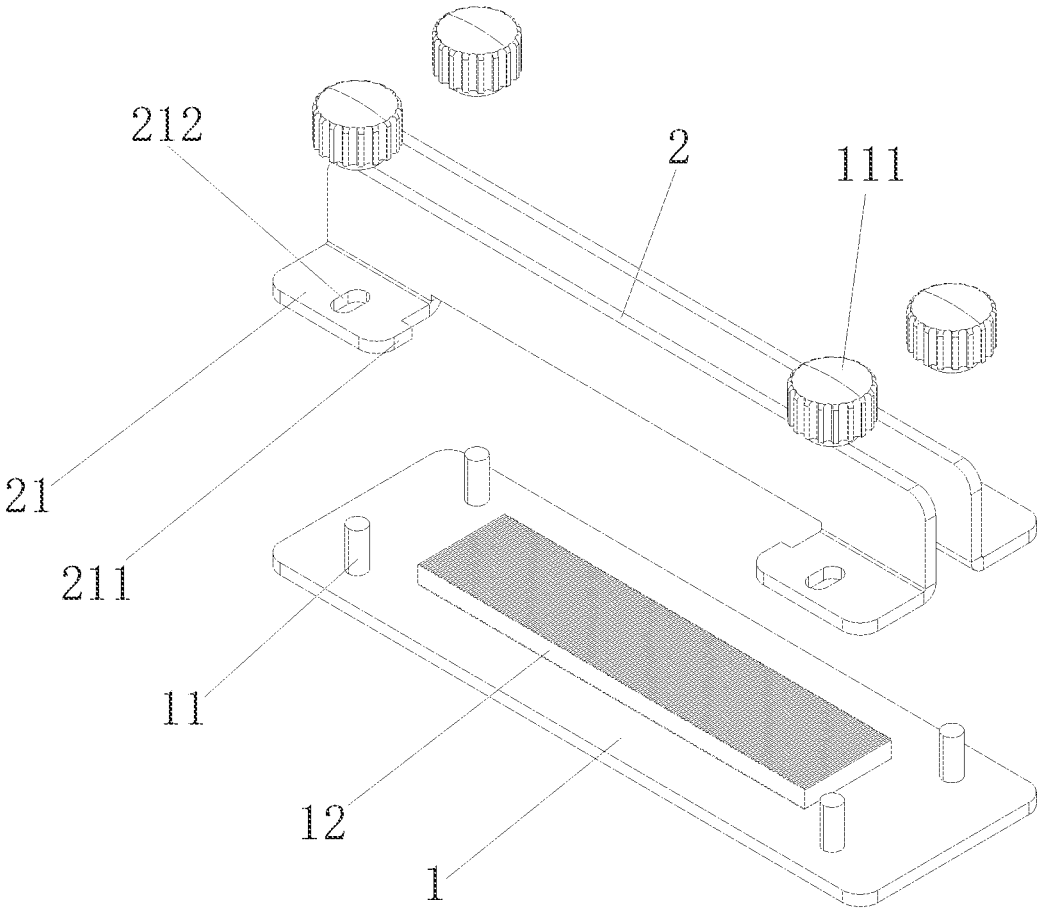
FIG. 2 is an exploded view of the overall structure of the present application.

Referring to FIGS. 1-2, the present application provides an edge sharpening tool for an acrylic wax scraper, including a base plate 1; baffles 2 are symmetrically installed on the top surface of the base plate 1, and a file 12 is placed between the baffles 2. The baffles 2 each are provided with a bottom surface 21 that is in an L-shaped configuration with the baffle. The side of the bottom surface 21 away from the end of the baffle in the length direction is provided with a protruding section serving as a limit block 211, and the limit block 211 limits the movement of the file 12. Due to the limit of the horizontal movement of the file 12 by the limit block 211, and under the limit of the baffles 2, it is convenient to scrape the acrylic wax scraper between the two baffles 2 to re-sharpen the blunt wax scraper due to long-term use, thus realizing reuse. Therefore, a simple edge sharpening tool for an acrylic wax scraper is achieved, with convenient operation, prolonged service life, and low cost.

In the present embodiment, especially referring to FIGS. 1-2, the top surface of the base plate 1 is provided with a plurality of screws 11 and matching nuts 111. The bottom surface 21 is fixed on the top surface of the base plate 1 through the screws 11 and the nuts 111. The baffles 2 are easily installed and fixed through the screws 11 and the nuts 111.

In the present embodiment, especially referring to FIGS. 1-2, the baffles 2 each are provided with a notch in the middle of the baffle 2 adjacent to the bottom surface 21. The file 12 is placed in the space formed between the notch and the base plate 1. The baffles 2 press and fix the file 12. The file 12 is pressed and fixed by the baffles 2 together with the screws 11 and the matching nuts 111 to ensure the stable fixation of the file 12, resulting in a reliable and firm structure.

In the present embodiment, especially referring to FIGS. 1-2, the bottom surface 21 is symmetrically arranged at two ends of the baffle 2 adjacent to the notch, and the bottom surface 21 is bent outward.

In the present embodiment, especially referring to FIG. 2, the bottom surface 21 is provided with a long cutout 212 along the bending direction. The screws 11 are inserted into the baffles 2 through the long cutout 212, and the baffles 2 are fixed by the nuts 111. The long cutout 212 has an oblong shape. A certain space allowing a relative movement of the oblong long cutout 212 and the screw 11 fixed on the base plate 1 is formed in the width direction, so that the baffles 2 can be moved to increase or decrease the distance between the two baffles 2, and the matching nuts 111 are used for pressing and fixation, which realizes edge sharpening of acrylic wax scrapers with different thicknesses and is highly applicable.

The present application has been exemplarily described above in conjunction with the accompanying drawings. It is obvious that the specific implementation of the present application is not limited by the above-mentioned embodiments. Non-substantive improvements made using the inventive concept and technical solution of the present application, or direct applications of the inventive concept and technical solution of the present application without modifications to other situations, are all within the protection scope of the present application.

What is claimed is:

1. An edge sharpening tool for an acrylic wax scraper, comprising a base plate (1);

wherein two baffles (2) are symmetrically installed on a top surface of the base plate (1), a file (12) is placed between the two baffles (2), the two baffles (2) each are provided with a bottom surface (21) in an L-shaped configuration with the two baffles, a side of the bottom surface (21) away from an end of each of the two baffles in a length direction is provided with a protruding section serving as a limit block (211), and the limit block (211) limits a movement of the file (12);

wherein the top surface of the base plate (1) is provided with a plurality of screws (11) and matching nuts (111), the bottom surface (21) is fixed on the top surface of the base plate (1) through the screws (11) and the matching nuts (111);

wherein the two baffles (2) each are provided with a notch, and the file (12) is placed in a space formed between the notch and the base plate (1); and wherein the notch is provided in a middle of each of the two baffles (2) adjacent to the bottom surface (21).

2. The edge sharpening tool for the acrylic wax scraper according to claim 1, wherein the bottom surface (21) is symmetrically arranged at two ends of each of the two baffles (2) adjacent to the notch.

3. The edge sharpening tool for the acrylic wax scraper according to claim 2, wherein the bottom surface (21) is bent outward.

4. The edge sharpening tool for the acrylic wax scraper according to claim 3, wherein the bottom surface (21) is provided with a long cutout (212) along a bending direction, the screws (11) are inserted into the two baffles (2) through the long cutout (212), and the two baffles (2) are fixed by the matching nuts (111).

5. The edge sharpening tool for the acrylic wax scraper according to claim 2, wherein the bottom surface (21) is provided with a long cutout (212) along a bending direction, the screws (11) are inserted into the two baffles (2) through the long cutout (212), and the two baffles (2) are fixed by the matching nuts (111).

6. The edge sharpening tool for the acrylic wax scraper according to claim 1, wherein the bottom surface (21) is provided with a long cutout (212) along a bending direction, the screws (11) are inserted into the two baffles (2) through the long cutout (212), and the two baffles (2) are fixed by the matching nuts (111).

7. An edge sharpening tool for an acrylic wax scraper, comprising a base plate (1);

wherein two baffles (2) are symmetrically installed on a top surface of the base plate (1), a file (12) is placed between the two baffles (2), the two baffles (2) each are provided with a bottom surface (21) in an L-shaped configuration with the two baffles, a side of the bottom surface (21) away from an end of each of the two baffles in a length direction is provided with a protruding section serving as a limit block (211), and the limit block (211) limits a movement of the file (12);

wherein the top surface of the base plate (1) is provided with a plurality of screws (11) and matching nuts (111), the bottom surface (21) is fixed on the top surface of the base plate (1) through the screws (11) and the matching nuts (111);

wherein the two baffles (2) each are provided with a notch, and the file (12) is placed in a space formed between the notch and the base plate (1); and wherein the two baffles (2) press and fix the file (12).

8. The edge sharpening tool for the acrylic wax scraper according to claim 7, wherein the bottom surface (21) is provided with a long cutout (212) along a bending direction, the screws (11) are inserted into the two baffles (2) through the long cutout (212), and the two baffles (2) are fixed by the matching nuts (111).

9. An edge sharpening tool for an acrylic wax scraper, comprising a base plate (1);

wherein two baffles (2) are symmetrically installed on a top surface of the base plate (1), a file (12) is placed between the two baffles (2), the two baffles (2) each are provided with a bottom surface (21) in an L-shaped configuration with the two baffles, a side of the bottom surface (21) away from an end of each of the two baffles in a length direction is provided with a protruding section serving as a limit block (211), and the limit block (211) limits a movement of the file (12);

wherein the top surface of the base plate (1) is provided with a plurality of screws (11) and matching nuts (111), the bottom surface (21) is fixed on the top surface of the base plate (1) through the screws (11) and the matching nuts (111); and wherein the bottom surface (21) is provided with a long cutout (212) along a bending direction, the screws (11) are inserted into the two baffles (2) through the long cutout (212), and the two baffles (2) are fixed by the matching nuts (111).

10. The edge sharpening tool for the acrylic wax scraper according to claim 9, wherein the long cutout (212) has an oblong shape.

11. The edge sharpening tool for the acrylic wax scraper according to claim 10, wherein through the oblong shape long cutout (212), the two baffles (2) are moved to increase or decrease a distance between the two baffles (2), and the matching nuts (111) are used for pressing and fixation.

* * * * *